US005135180A

United States Patent [19]

Morgan

[11] Patent Number: 5,135,180

[45] Date of Patent: Aug. 4, 1992

[54] GEARED CORE WINDER

[76] Inventor: Wade Morgan, 1611 Fabricon Blvd., Jeffersonville, Ind. 47130

[21] Appl. No.: 590,162

[22] Filed: Sep. 28, 1990

[51] Int. Cl.[5] ..... B65H 18/04; B23B 31/00

[52] U.S. Cl. ..... 242/67.1 R; 242/72 R; 279/2.02

[58] Field of Search ..... 242/68, 68.1, 68.2, 242/68.3, 68.4, 72 R, 46.4, 46.5; 269/48.1, 48.2, 48.3; 279/2 R

[56] References Cited

U.S. PATENT DOCUMENTS

| | | | |
|---|---|---|---|
| 1,037,988 | 9/1912 | Richards . | |
| 1,244,865 | 10/1917 | Krohn . | |
| 1,494,396 | 5/1924 | Wendt | 242/68 |
| 1,870,243 | 8/1932 | Duston | 242/72 R |
| 2,231,140 | 2/1941 | Richardson | 242/68 |
| 2,379,091 | 6/1945 | LeTourneau | 242/72 R |
| 2,771,251 | 11/1956 | Silverstein | 242/68 |
| 3,146,964 | 9/1964 | Schultz et al. | 242/68.3 |
| 3,224,701 | 12/1965 | Wynne | 242/68.1 |
| 3,294,337 | 12/1966 | Jacob | 242/68.3 |
| 3,913,854 | 10/1975 | McClure | 242/75.4 |
| 4,037,804 | 7/1977 | Kopachkor | 242/68.3 |
| 4,284,251 | 8/1981 | Castillo | 242/68.4 |
| 4,750,682 | 7/1988 | Elliot | 242/68.2 |

OTHER PUBLICATIONS

Measuregraph Company, Brochure, Standard Features, May, 1985.

*Primary Examiner*—Daniel P. Stodola
*Assistant Examiner*—John P. Darling
*Attorney, Agent, or Firm*—Scott R. Cox

[57] ABSTRACT

A geared core winder for use with core rolls for fabric, material, rugs, paper or other such products comprised of a shaft containing a geared section, a first and second donut-shaped pieces placed on the shaft on opposite sides of the gears, a plurality of geared rods running between the donut-shaped pieces wherein there is secured to each geared rod a plate which extends from the surface of the geared rods wherein the geared rods interactingly engage the geared section of the shaft.

10 Claims, 5 Drawing Sheets

GEARED CORE WINDER

BACKGROUND OF INVENTION

1. Scope of Invention

This invention is a device for holding the core of a roll onto which is placed cloth, paper, rugs or other cloth or like materials. More specifically, this device is a geared core winder for holding the core of a roll used particularly with machines for measuring cloth or cloth-like material which is round onto large core rolls.

2. Prior Art

Devices for holding roll cores have been an important element of machines for the winding or measuring of cloth, paper, weblike products or other such sheet products for a number of years. Generally these products are wound onto hollow roll cores whose length frequently is in excess of 4 feet. Common roll cores are generally manufactured from a hollow thickened cardboard-like material with a wall thickness of about ⅛ to about ¾ of an inch. The overall diameter of these roll core may be anywhere from an inch to several inches.

Conventional devices for holding these roll cores, sometimes called chucks, are frequently ribbed to provide a better grip on the roll cores. For example, a conventional ribbed cone which is placed on a metal bar which runs within a core is disclosed in U.S. Pat. No. 1,244,865. U.S. Pat. No. 2,771,251 discloses a conventional machine for measuring the length of cloth which contains a pair of devices for holding the rolls of cloth. Each of these devices for holding the roll of cloth contains two chucks, 9, each of which is ribbed and one of each pair of which is adjustable in a horizontal plane to permit the device to hold various lengths of roll cores. A similar type of device for use with asphalt coatings is disclosed in U.S. Pat. No. 3,913,854. This device uses core engaging splines, 32, on the roll supporting units to hold the cores in place.

U.S. Pat. No. 1,037,988 discloses a core chuck with a key 3 which extends from the surface of a conical piece which fits within a notch in the roll core and, thus, restricts the movement of the roll core placed on the core chuck.

Another device designed for prevention of movement of a roll core is shown in U.S. Pat. No. 2,231,140 which discloses a core plug containing spiraling threads, 12, of greater diameter than the shaft, 8, of the core plug. These spiral threads tend to grab onto the inside of the roll core and restrict movement.

A more sophisticated device for holding roll cores for paper is disclosed in U.S. Pat. No. 4,284,251. This device discloses a bearing for supporting rolls of paper with an extension device, 7, which extends from the surface of the supporting device to grab the inner surface of the roll core. This extension device is extended out by the combination of a pair of telescopically coupled elements impacted by an expansion spring. See also U.S. Pat. No. 3,224,701 which discloses another device for holding a roll core.

Another device for gripping the inside of a roll core, designed by the Measuregraph Company of High Ridge of St. Louis, Mo., is a "U"-joint saw blade bar disclosed in an advertising brochure dated May, 1985. In this device, a single blade is affixed to a shaft which runs inside of a roll core. The blade is secured to the central core along one edge with the inner portion inside of an outer circular piece thus permitting the saw blade to rise to a position outside of the outer circular piece and grab the inside of a roll core.

Although each of these products provides a core winding device for controlling the movement of a roll core which holds paper, fabric or web-like products, there is still a need for improvements to the core winder. Specifically, current core winders tend to tear the core rolls because of their ribbed surface structure. In addition, slippage is still a significant problem especially with large rolls of material. Further, current core winders have difficulty in adjusting to different size roll cores and may require a number of different core winder devices to fit various sizes of roll cores.

Accordingly, it is an object of this invention to produce a core winder which will be useful in the winding of fabric, rugs, paper, materials and other web-like products on roll cores.

It is another object of this invention to produce a core winder that is less destructive of the roll cores when the core winder is in operation.

It is a still further object of this invention to produce a core winder with less slippage of the roll cores and which produces less vibration when the roll core is turned.

It is a still further object of this invention to provide a core winder which can be used for various diameters of roll cores.

These and other objects of the invention will be apparent from a review of the description and the appended claims.

SUMMARY OF INVENTION

In accordance with the present invention there is provided a geared core winder comprised of a. a shaft containing a first section and a partially geared second section;

b. a first donut-shaped piece with a central opening through which the second section of the shaft passes;

c. a second donut-shaped piece with a central opening through which a portion of the second section of the shaft passes;

d. a plurality of geared rods wherein each end of each geared rod extends into the inner sides of the first and second donut-shaped pieces, wherein each geared rod runs parallel to the second section of the shaft, and wherein each geared rod interactingly engages with the geared portion of the partially geared second section;

e. a plurality of plates, each of which is secured to one of the geared rods; and f. a means for holding the second donut-shaped piece onto the shaft.

The geared core winder as described is attached to a machine for rolling cloth or other such material and fits within a roll core which holds cloth, paper or other such material to prevent unwanted rotation and vibration of the roll core. This unwanted rotation is prevented by means of the interaction between the plates of the geared core winder and the inside surface of the roll cores. The plates of the geared core winder center the roll core causing less vibration as the roll core is turned. This geared core winder provides a significant improvement over any

DETAILED DESCRIPTION OF THE DRAWINGS

This invention will now be described with reference to the accompanying drawings in which.

DETAILED DESCRIPTION OF THE PREFERRED EMBODIMENT

Figure 1:
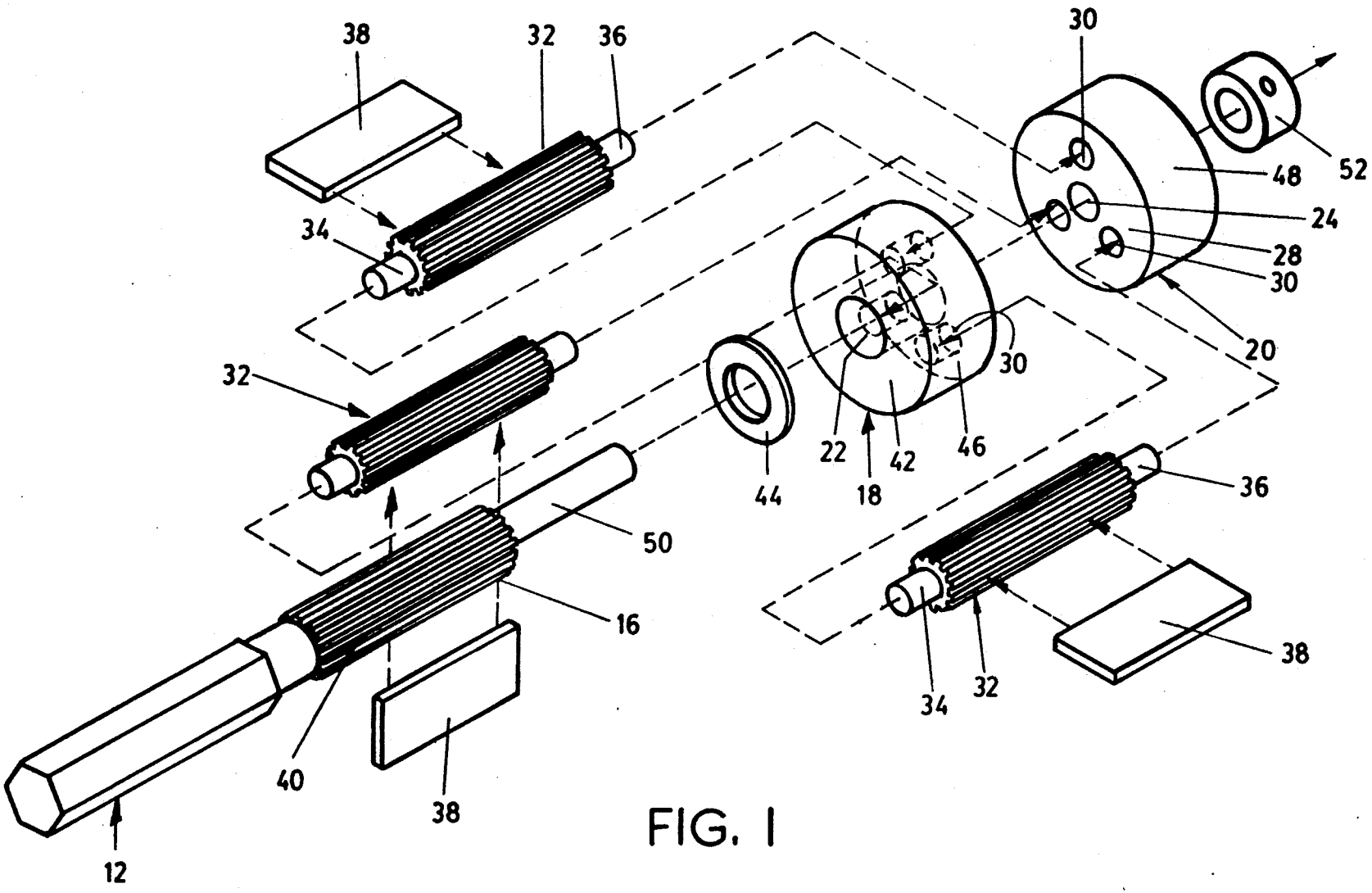
FIG. 1 is an exploded view of the geared core winder.
Figure 2:
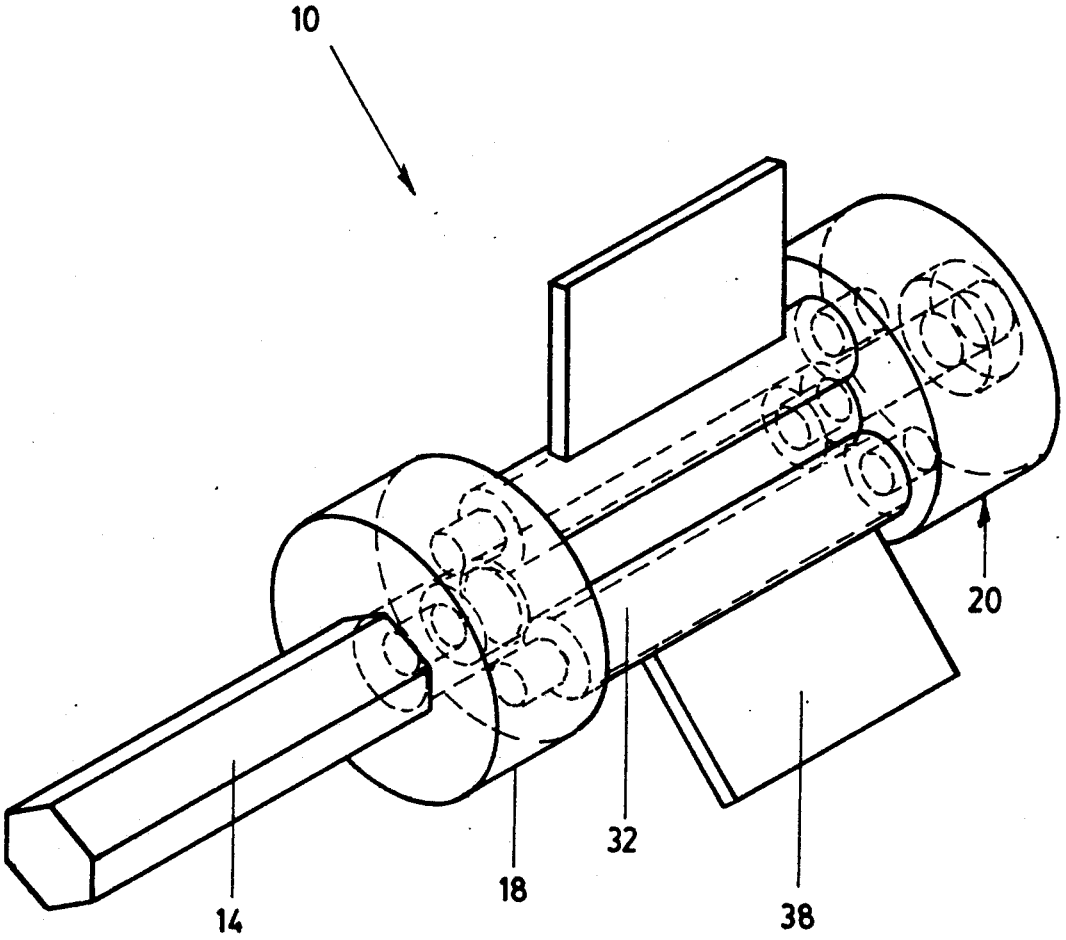
FIG. 2 is a side perspective view of the geared core winder with the plates projecting from the winder.

Although the invention is adaptable to a wide variety of uses, it is shown in the drawings for purposes of illustration as embodied in a geared core winder (10) comprised of a shaft (12) containing a first section (14) and a partially geared second section, (16) a first (18) and second (20) donut-shaped piece, each with a central opening (22, 24) through which a portion or all of the second section of the shaft passes, wherein the surfaces (26, 28) of the first and second donut-shaped pieces which face each other (the inner surfaces) each contain a plurality of openings (30); a plurality of geared rods, (32) wherein each end of each geared rod (34, 36) extends into one of the openings (30) in the inner surfaces of the donut-shaped pieces (18, 20); a plurality of plates, (38) wherein each is secured to one of the geared rods (32); and a means for holding the donut-shaped pieces onto the shaft. See FIGS. 1 and 2.

Figure 3:
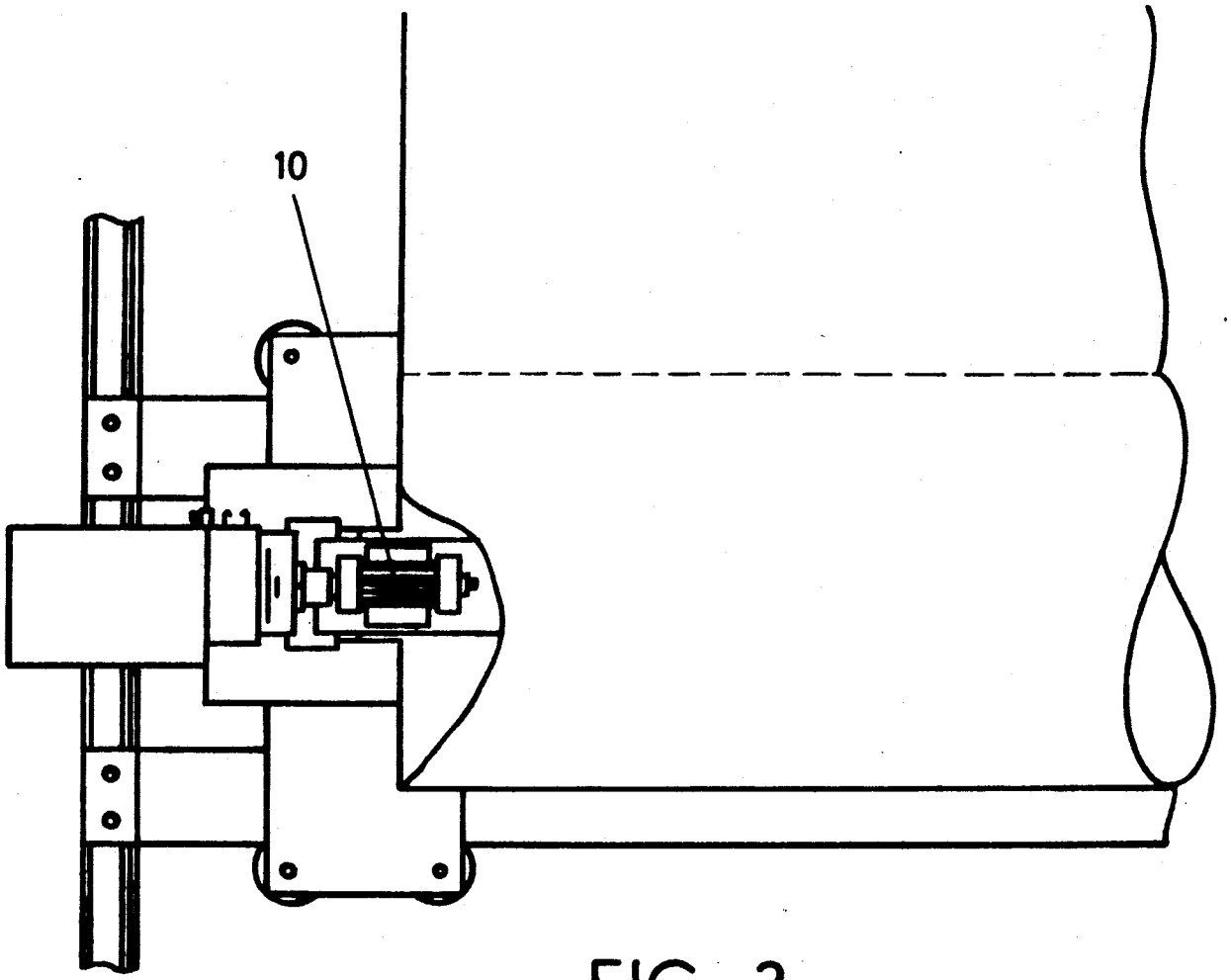
FIG. 3 is a front view showing the geared core winder in use with a cloth measuring machine.

The shaft (12) of the geared core winder (10) is divided into the first section (14) and the partially geared second section. (16) The first section extends into the machinery used to wind the fabric or other such material, to measure the fabric, and for many other common activities wherein a significant amount of material is contained upon a fabric roll. See FIG. 3. Devices for measuring fabric are generally made, for example, by Measuregraph of St. Louis, Mo. In a preferred embodiment the first section (14) of the shaft has a hexagonal cross section, is about ½ to about 2 inches in thickness and is preferably about 2 to about 8 inches in length. The thickness of the cross sectional portion is not critical and will depend on the type of machinery into which the device is inserted. The hexagonal shape is also not critical but that shape is chosen as a conventional shape for use with conventional measuring equipment.

There is secured to the first section of the shaft the partially geared second section (16). This partially geared second section can be a separate portion of the shaft (12) which is secured to the first section (14) or it can be an extension of the first section (14) wherein the entire shaft is formed from a single piece. At least a portion (40) of this second section is generally circular in a cross section containing gears with the number, size and thickness of the gears dependent upon the desire of the manufacturer. These gears are conventional gears used in machinery and are not unique in size, shape or construction to this device. There are approximately 10–20 gears in the diameter of the partially geared second section (16) of the shaft, each gear being approximately 1/32 to about ¼ of an inch in height. The diameter of the partially geared second section is also not critical but is preferably from about ½ to about 1-½ inch.

Figure 4:
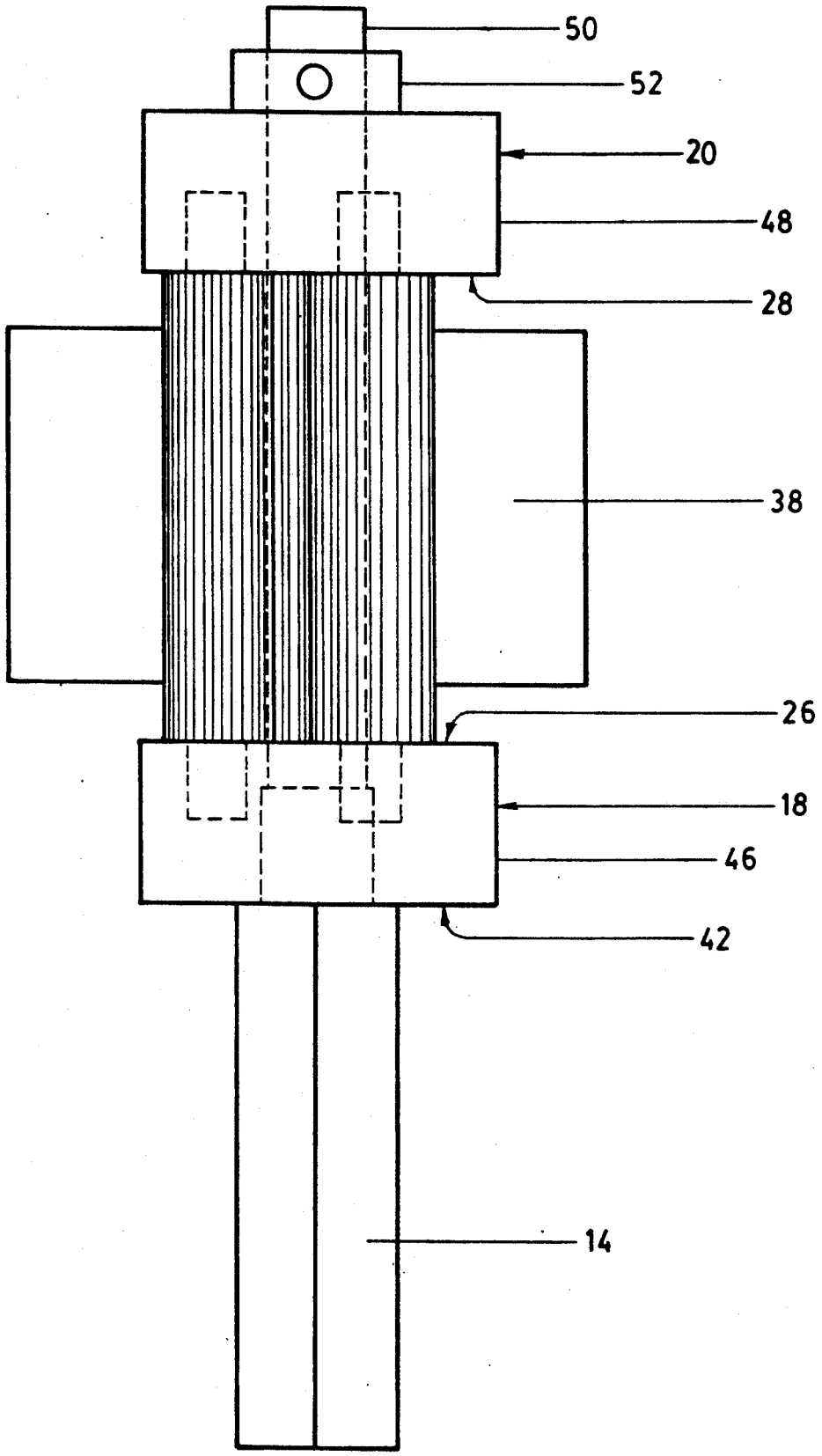
FIG. 4 is a top view of the geared core winder with the plates extended.

Placed over the shaft at the end of the first section is the first donut-shaped piece. (18) This first donut-shaped piece is generally circular in cross section with an overall diameter less than the size of the roll cores into which the geared core winder is inserted. For example, when the opening in the fabric roll core is approximately 2 to 2-½ inches, the donut-shaped piece should be at least about ¼ of an inch less in diameter and preferably ½ of an inch less in diameter than the diameter of the opening in the roll core. The first donut-shaped piece (18) rotates freely around at least a portion of the circumference of the partially geared second section. See FIG. 4.

The first donut-shaped piece (18) has inner (26) and outer (42) flattened surfaces. The first donut-shaped piece itself is approximately ½ to about 2 inches in thickness, although its thickness is not critical.

In a preferred embodiment a washer, (44) preferably a plastic washer, is placed between the inner end of the first section of the shaft and the outer surface (42) of the first donut-shaped piece (18) to permit free rotation of the first donut-shaped piece on the shaft. (12) See FIG. 2.

The inner surface (26) of the first donut-shaped piece contains a number of openings (30) extending approximately half the thickness of the donut-shaped pieces. (18, 20). See FIG. 4. The depth of each of these openings is not critical.

The second donut-shaped piece (20) is approximately the mirror image of the first donut-shaped piece. (14) It is separated from the first donut-shaped piece by that portion (40) of the partially geared second section (16) which is geared. The center opening (24) in the second donut-shaped pieces is preferably smaller in diameter than the diameter of the geared portion (40) of the partially geared second section. See FIG. 2. This smaller diameter restricts the second donut-shaped piece (20) from extending over the geared portion (40) of the partially geared second section. (16) The second donut-shaped piece (20) also contains openings (30) in its inner surface which face the openings in the inner surface of the first donut-shaped piece and are approximately the same size and depth. These openings are for receipt of the ends (34, 36) of the geared rods (32). The number of these openings is dependent upon the desire of the manufacturer, but in a preferred embodiment a minimum of three such openings is provided in each donut shaped piece.

Running between each pair of these openings in the first and second donut-shaped pieces are the geared rods (32). The geared rods are comprised of three elements, the first (34) and second ends (36) which project into the openings in each of the flattened surfaces of the first and second donut-shaped pieces and a geared portion of the geared rods. The overall length of each of these geared rods is not critical but it should be at least about 1-½ inches and, preferably, 1-½ to 4 inches. Each of these geared rods contain gears of approximately the same size as the gears contained in the geared portion (40) of the partially geared second section. In addition, each of these geared rods (32) run parallel to the geared portion (40) of the partially geared second section and each interactingly engages the geared portion of the partially geared second section. Each end (34, 36) of these geared rods (32) fits within the openings (30) contained in the inner surfaces (26, 28) of the first (18) and second (20) donut-shaped pieces with each of these openings being of sufficient size to permit the free and smooth rotation of the geared rods within these openings. The result of the interacting engagement of the geared portion (40) of the partially geared second section with each geared rod (32) is that upon rotation of the geared portion (40) of the partially geared second section, each of the geared rods (32) will also rotate.

Figure 5:
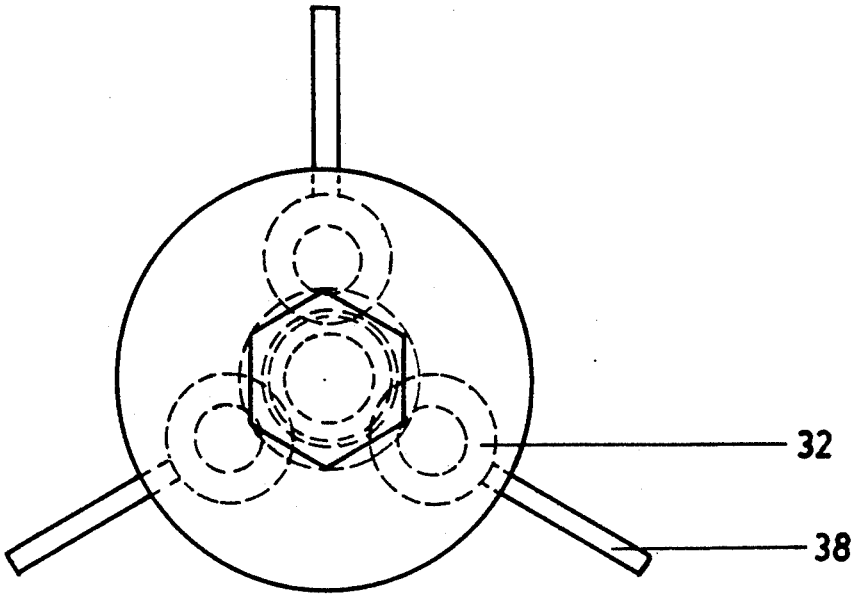
FIG. 5 is an end view of the geared core winder.

Secured to each geared rod is the plate (38). Each plate is generally rectangular and is not as long as is the geared portion of each of the geared rods (32). Its height may vary, although preferably, its height is about ½ to about 2 inches. The thickness of these plates can also vary from about ⅛ inch to about ½ inch. The height of these plates will depend on the overall size of the geared core winder (10) and the distance of the geared rods (32) from the outside surfaces (46, 48) of each of the donut-shaped pieces. It is preferable for the height of the plates to be sufficient so that when properly rotated they will hit the surface of the adjacent geared rod and project over the outside surfaces of the donut shaped pieces. See FIG. 5.

Figure 6:
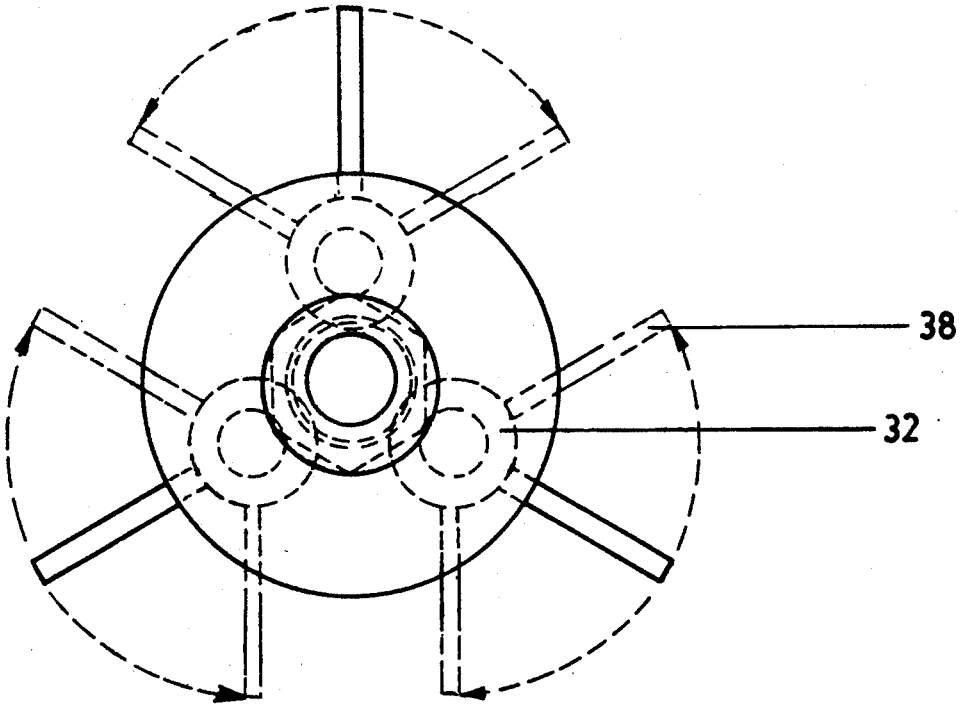
FIG. 6 is an end view of the geared core winder showing the rotation of the plates of the geared core winder.

The arrangement of each of these plates on the geared rods is important. The plates are secured to the geared rods such that each extends approximately perpendicular from a tangent to the surface of the geared rods (32) with the point of contact of the tangent with the geared rod being where the plate (38) meets the geared rod (32). In addition, the plates (38) run parallel to the gears of the geared rod. See FIG. 5. The angle of attachment of the plates to the geared rods can vary up to about 30° off the perpendicular without significantly reducing the effectiveness of the geared core winder. Further variation off the perpendicular is possible, but that variation will reduce the effectiveness of the geared core winder. In addition, each of the plates (38) should extend approximately perpendicular at the same time, that is, when one plate is perpendicular to the tangent of its geared rod, all of the plates should be approximately perpendicular to their respective tangents. Although such perpendicularity is important for all of the plates, it is not critical and minor variations are acceptable. See FIG. 6. The plates can be secured to the geared rods by any conventional method, such as by welding.

The outer end (50) of the partially geared second section (16) extends out from the outer surface of the second donut-shaped piece (20) a sufficient distance to permit a means for holding the second donut-shaped piece onto the shaft to be secured to the shaft. This means for holding the second donut-shaped piece onto the shaft can be any conventional means such as a bolt, a nut, or preferably a ring (52) with securing screw which secures against the surface of the shaft.

The entire device, other than the plastic washer, is preferably made of high strength metal, preferably tempered steel.

In operation, the first section of the shaft (14) is placed within a complementary holding portion of a machine for measuring the length of cloth or for rolling rolls of fabric, etc. Because of its hexagonal shape, the first section is held securely within the cloth measuring machine. The first (18) and second (20) donut-shaped pieces are then rotated fully in one direction. This rotation moves the plates (38) on the geared rods (32) until they are projecting a minimum distance outward from the geared core winder (10) and preferably rest against the adjacent geared rod. A roll, such as a fabric roll or cloth roll, is then placed over the first (18) and second (20) donut-shaped pieces. The first section (14) of the shaft (12) is then rotated. As it rotates, it also rotates the partially geared second section (16) of the shaft. This partially geared second section (16) then rotates the geared rods. (32) The geared rods (32) then rotate the plates (38) outward until they contact the inside surface of the roll core. See FIG. 6. These plates then bite into the inner surface of the roll core and controls the movement of the roll core. This control not only the forward speed of rotation of the roll core but also prevents the roll core from backing up unexpectedly because of the interaction of the plates (38) with the inside of the roll core. The plates when contracting the roll core tend to center the roll core causing less vibration as the roll is turned.

I claim:

1. A geared core winder comprised of
   (a) a shaft containing a geared portion;
   (b) a first donut-shaped piece with a central opening, wherein said first donut-shaped piece is rotatably supported by the non-gear portion of the shaft, such that said first donut-shaped piece is located entirely on one side of the geared portion;
   (c) a second donut-shaped piece with a central opening wherein said second donut-shaped piece is rotatably supported by the non-gear portion of the shaft, located entirely on the opposite side of the geared portion of the shaft from the first donut-shaped piece;
   (d) a plurality of geared rods rotatingly secured between the first and second donut-shaped pieces and around the shaft wherein each geared rod meshes with the geared portion of the shaft; and
   (e) a plurality of plates, each of which is secured to one of the geared rods wherein said plates can be extended both when said shaft is rotated clockwise and counterclockwise.

2. The geared core winder of claim 1 wherein three geared rods are present.

3. The geared core winder of claim 1 wherein each of the plates are secured to the geared rods such that each plate is within 15° of perpendicular to a tangent formed at the point where the plates meet the geared rods.

4. The geared core winder of claim 1 wherein the geared portion of the shaft contains about 10 to about 20 gears.

5. A geared core winder comprised of
   (a) a shaft containing a first section and a partially geared second section;
   (b) a first donut-shaped piece containing flattened inner and outer surfaces and a central opening wherein said first donut-shaped piece is rotatably supported by the non-gear portion of the second section of the shaft;
   (c) a second donut-shaped piece containing flattened inner and outer surfaces and a central opening wherein said second donut-shaped piece is rotatably supported by the non-gear portion of the second section of the shaft;
   (d) a plurality of geared rods wherein each end of each geared rod extends into the inner surfaces of the first and second donut-shaped pieces and around the shaft, wherein each geared rod runs parallel to the second section of the shaft and wherein each geared rod meshes with the partially geared second section;
   (e) a plurality of plates each of which is secured to one of the geared rods wherein said plates can be extended both when said shaft is rotated clockwise and counterclockwise; and (f) a means for securing the second donut-shaped piece on the shaft.

6. The geared core winder of claim 5 wherein three geared rods are present.

7. The geared core winder of claim 5 wherein each of the plates are secured to the geared rods such that each plate is within 15° of perpendicular to a tangent formed at the point where the plates meet the geared rods.

8. The geared core winder of claim 5 wherein the first section of the shaft is hexagonal in a cross section.

9. The geared core winder of claim 5 wherein the means for securing the second donut-shaped piece on the shaft is a ring containing a securing screw which tightens against the shaft.

10. The geared core winder of claim 5 wherein the partially geared second section contains about 10 to about 20 gears.

* * * * *